United States Patent [19]

Carlson

[11] Patent Number: 4,650,216

[45] Date of Patent: Mar. 17, 1987

[54] PAPERBACK-HARDCOVER CONVERSION INSERT

[76] Inventor: Dennis W. Carlson, 17624 182nd NE., Woodinville, Wash. 98072

[21] Appl. No.: 494,819

[22] Filed: May 16, 1983

[51] Int. Cl.[4] ..... B42D 3/04; B42D 3/00; B42F 13/20; B42C 15/00

[52] U.S. Cl. ..... 281/34; 281/21 R; 402/77; 412/21

[58] Field of Search ..... 281/3 R, 4, 17, 20, 281/21 R, 29, 31, 34, 15 R, 23, 21; 282/8 R; 412/4, 15, 19, 21; 402/77

[56] References Cited

U.S. PATENT DOCUMENTS

| | | | |
|---|---|---|---|
| 316,051 | 4/1885 | Mulqueen | 281/29 |
| 468,780 | 2/1892 | Bowman | 281/15 R |
| 1,844,516 | 2/1932 | Meyer et al. | 412/21 |
| 2,338,891 | 1/1944 | Auburn | 402/77 |
| 3,099,465 | 7/1963 | Hazel, Jr. | 281/36 |
| 3,161,423 | 12/1964 | Hertzberg | 281/21 R |
| 3,167,328 | 1/1965 | Dengle et al. | 281/20 |
| 3,241,863 | 3/1966 | Paddack | 281/29 |
| 3,244,436 | 4/1966 | McKowen | 281/23 |
| 3,252,462 | 5/1966 | Quarton et al. | 281/34 |
| 3,708,813 | 1/1973 | Carter et al. | 412/21 |
| 4,091,487 | 5/1978 | Axelrod | 281/21 R |
| 4,209,187 | 6/1980 | Forrest | 281/19 R |
| 4,274,659 | 6/1981 | D'Ambrosio | 281/34 |

*Primary Examiner*—Paul A. Bell

*Assistant Examiner*—Paul M. Heyrana, Sr.

*Attorney, Agent, or Firm*—Seed and Berry

[57] ABSTRACT

A paperback-hard cover conversion insert and a method for using same. The insert is usable with a hard book cover having two spaced-apart stiff panel portions and a flexible hinge portion therebetween. The insert includes a flexible sheet attachable to the panel portions; a narrow, stiff piece of material with a configuration typical of that of a spine of a book, having a first side which is convex and a second side which is concave; and a compressible resilient material having in cross-section a generally elliptical configuration. The narrow, stiff piece of material has its first side attached to the flexible sheet between said panel portions, and its second side attached to a first convex side of the compressible, resilient material. The second convex side of the compressible resilient material is attachable to the spine of a book to position the book between the panel portions. The flexible sheet further includes a pair of pockets to receive the soft covers of the book, and the compressible resilient material has longitudinal end guides to assist in longitudinal positioning of the book spine with respect to the compressible resilient material. The second side of the compressible resilient material has an adhesive surface with a peel-away cover. The insert is useful in converting a paperback book to a hardback book, and can be used in the original manufacture of hard cover books.

40 Claims, 8 Drawing Figures

PAPERBACK-HARDCOVER CONVERSION INSERT

BACKGROUND OF THE INVENTION

Each year millions of paperback books are manufactured and sold. Although these paperbacks are considerably less expensive to buy than the original hard cover editions, the last few years have seen even these inexpensive paperbacks growing in price. Many now exceed $3.00 to $4.00 a book. As price continues to rise, these once thought to be short-term use paperbacks are being kept as the main literary work of many home libraries.

Paperback books are usually smaller in size than their original hard covered editions and are printed on less expensive paper. However, they are considered for short-term-use-only, because of the inexpensive binding and paper covers used. These inexpensive paper covers do not stand up to repeated use or long life on library shelves. Paperbacks tend to become very unsightly over time and the paper cover allows it to become easily tattered, torn, and misshapen.

I have many paperback novels and have desired a way of salvaging these once thought to be short-term-use books by converting their paper covers to conventional rigid cloth bookcovers. Rigid cloth bookcovers would not only protect the paperbacks from being tattered, torn and misshapen, but also add to their appearance and therefore value to the owner. The invention herein described, when bonded to a rigid cloth bookcover commonly available in the industry, would permit a paperback consumer to easily convert a short-term-use paperback novel to a novel of quality appearance capable of years of use and enjoyment by many people.

THE GENERAL DESCRIPTION OF THE INVENTION

This invention comprises a central part of an elliptical configuration of foam-type compressible material with one side adhered to a narrow piece of stiff material such as paperboard for rigidity and the other side adhered to a foam-type strip with its outer side having an adhesive covered with a peel-away backing. The outer side of the paperboard as well as the sides of the paperboard and two foam-type materials are adhered to a paper backing with pockets at each end. When the outer two sides of the paper backing of this invention are bonded or otherwise adhered to a conventional rigid cloth bookcover it becomes a means of allowing the ultimate paperback consumer to convert a paperback book with a soft cover to a book with a permanently fastened rigid cloth cover. The consumer simply peels away the paper backing exposing the adhesive underneath. The consumer then holds the paperback novel with its back or spine towards the adhesive strip, and simply centers the book's spine with respect to the adhesive strip and presses the spine firmly against the adhesive. Then the paper covers of the paperback are fit into their respective pockets of the insert to complete the conversion.

THE DRAWINGS

THE SPECIFIC DESCRIPTION OF THE INVENTION

The object of the invention is to provide an insert or interface 16 between a rigid cloth bookcover 18 and a paperback book. The insert is connected to the rigid cloth bookcover by an adhesive and is connected to the spine of the paperback book by an adhesive. The insert has pockets to receive the paper cover of the paperback book. By means of the insert there results a permanent rigid cloth bookcover for a paperback book which extends the life of the book. A paperback book used without the present invention is subject to damage by tearing and resulting fraying of the paperback bookcover. The invention makes it possible for a person to build a personal library at less cost with paperback books than with hardcover books, since the combination of the paperback book, the insert and a rigid cloth bookcover is less expensive than an original edition, hardcover book.

Figures 1, 2, 3:
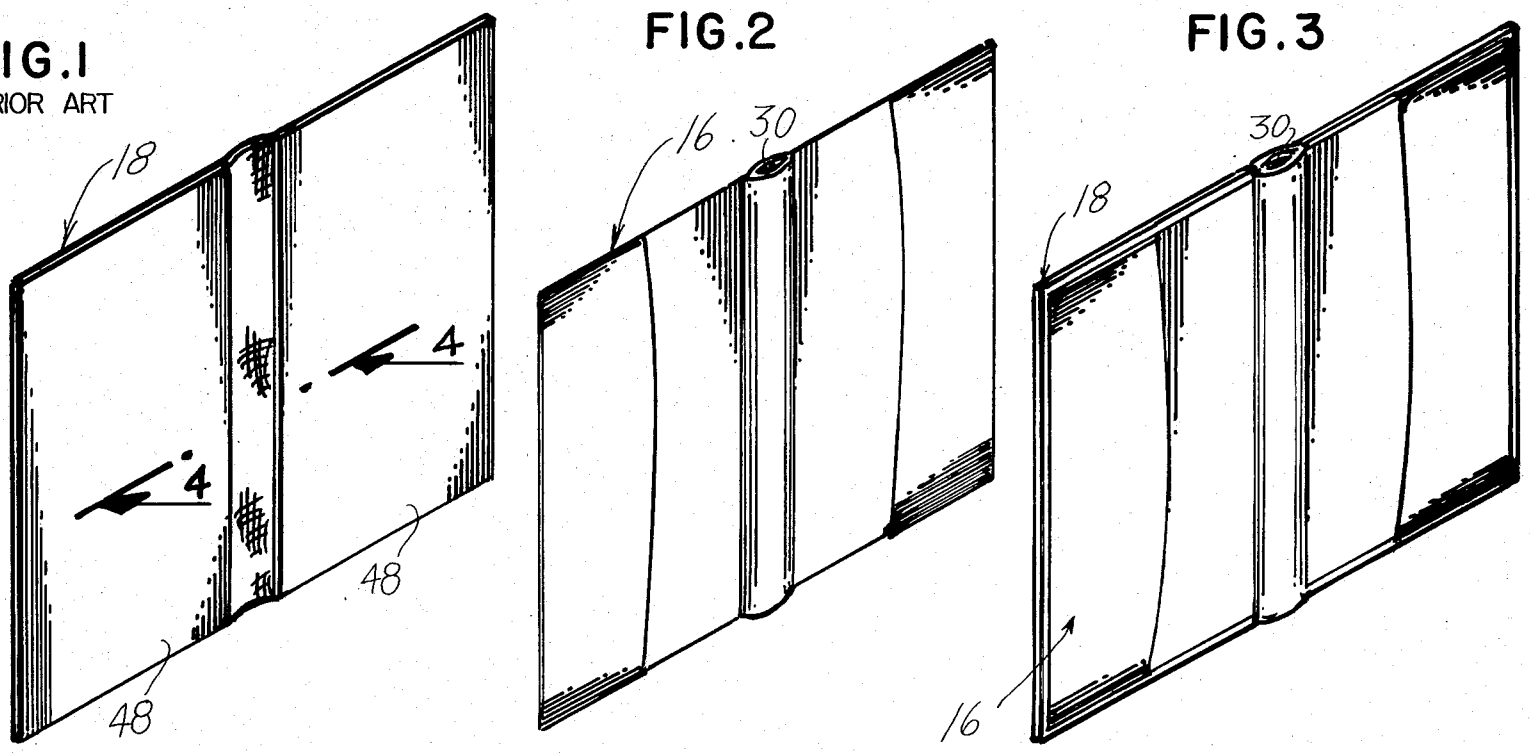
FIG. 1 PRIOR ART
FIG. 1 is a perspective view of a conventional rigid cloth bookcover.
FIG. 2 is a perspective view of the materials of construction of an insert or interface in accordance with the present invention for binding a rigid cloth bookcover to a paperback book.
FIG. 3 is a perspective view looking at the invention herein described permanently bonded to a rigid cloth bookcover and in a condition to be bonded to a paperback book.
Figure 4:
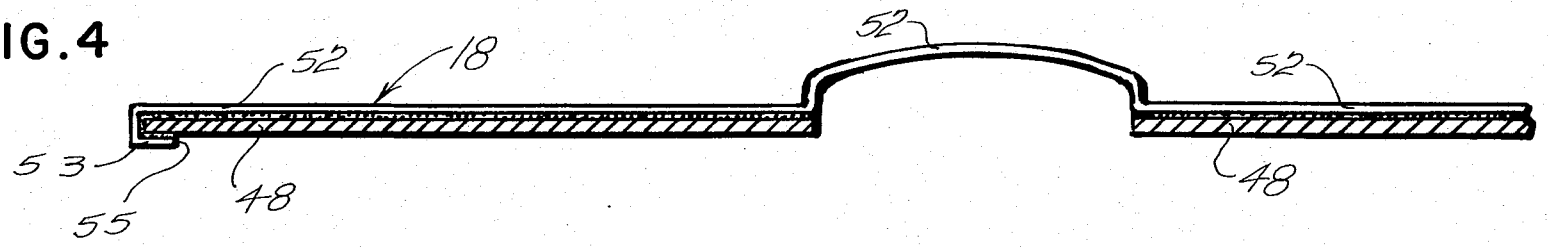
FIG. 4 is a lateral cross-sectional view of the rigid cloth bookcover.
Figure 5:
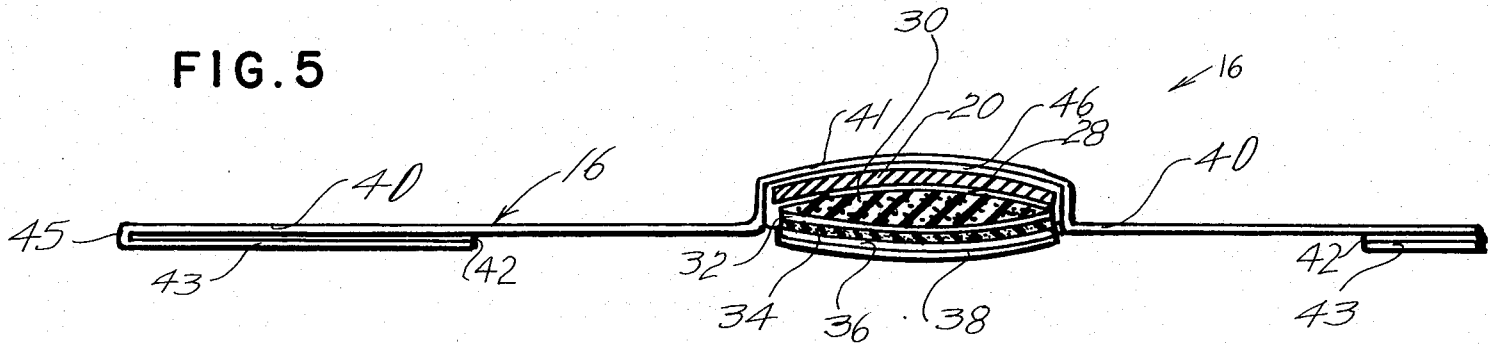
FIG. 5 is a lateral cross-sectional view illustrating the insert or interface which is positioned between the paperback book and the rigid cloth bookcover.
Figure 6:
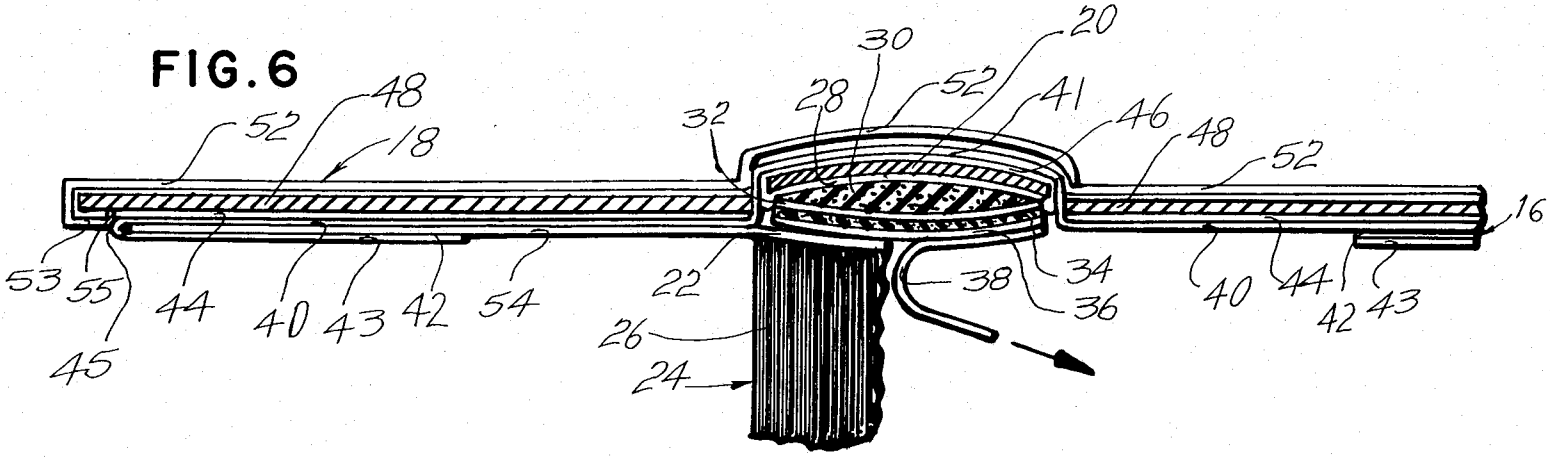
FIG. 6 is a lateral cross-sectional view illustrating the insert or interface connected to the rigid cloth bookcover and also being connected to the paperback book 24.

The insert of FIGS. 2 and 5 comprises a stiff material 20 which can be paperboard. As is seen in FIGS. 5 and 6 the material 20 is convex on one side and concave on the other side. In FIGS. 5 and 6 it is seen that this stiff narrow material 20, in lateral cross-sectional configuration, appears in the form of an arc. It is this stiff material 20 which conforms to the configuration of a spine 22 of a paperback book 24 having pages 26. Then an adhesive 28 connects the concave side of the stiff material 20 with one side of a compressible, resilient material 30. One desirable compressible, resilient material is a solid plastic foam such as polyurethane foam, polyethylene foam, polyproplene foam, and polyvinylchloride foam, to name a few appropriate solid plastic foams. The material 30 must be capable of being compressed or expanded and then when the pressure is relieved on the foam, the foam must be capable of expanding back to its moreorless original shape. In other words, the material should have memory. In FIGS. 5 and 6 it is seen that the material 30 in cross-section is of a generally elliptical configuration, i.e., both sides being convex.

There is an adhesive 32 on the outer side of the foam 30. The adhesive 32 bonds to the material 30 and to another soft compressible resilient material such as latex foam 34. The foam 34 may be a strip of material.

Then, there is an adhesive 36 applied to the outer or free side of the foam 34. This adhesive is covered with a paper backing 38 capable of being peeled away and exposing the adhesive 36. However, the adhesive 36 is protected by the paper backing 38 until it is appropriate to contact the adhesive with the spine 22 of the paperback book 24.

Figure 8:
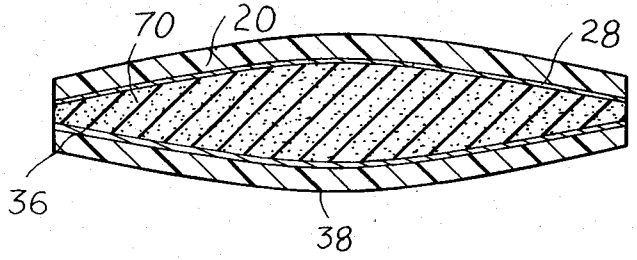

In a mass production manufacturing stage one foam piece 70 can be used as depicted in FIG. 8 rather than two foam pieces for material 30 and foam 34 shown in FIGS. 5 and 6.

There is a backing sheet 40 which is a flexible, limber sheet, usually of paper. This backing sheet is folded back on itself at the two extreme ends to form pockets 42 having an outer sheet 43. At the junction of the backing sheet 40 and the outer sheet 43 there is an edge 45. An adhesive 44 bonds the respective outer edges of the pocket 42 and the backing sheet 40.

Then, adhesive 46 connects the pocket side of the paper backing sheet 40 to the outer or convex side of the stiff material 20 and to the outer edges of the stiff material 20.

Figure 7:
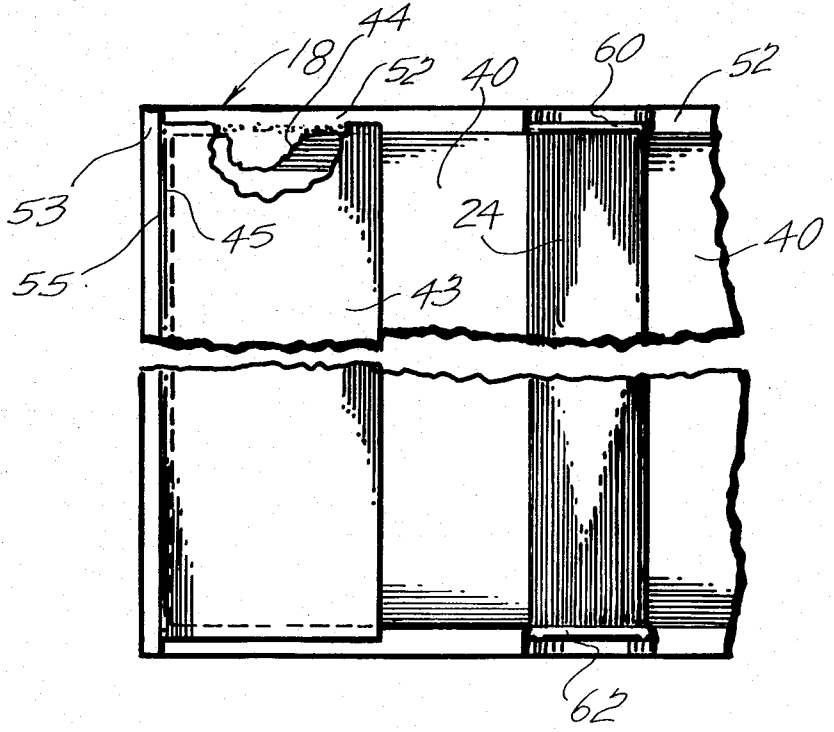
FIG. 7 is a fragmentary elevational view looking at the combination of the paperback book, the insert or interface and the rigid cloth bookcover; and, FIG. 8 is an enlarged fragmentary end view of the spine or center section of the invention depicting the use of only one foam.

In FIG. 7 there is illustrated a front elevational view of the insert 16. The compressible material 30 has a lateral upper guide 60 and a lateral lower guide 62. The guides 60 and 62 are not covered by the foam 34 and are not covered by the adhesive 32 and 36. With the guides 60 and 62 it is possible to more easily position the spine 22 with respect to the foam 34 of the insert 16.

The free or non-pocket sides of backing sheet 40 are bonded by adhesive 44 to the inside surface of the two sides 48 of the conventional rigid cloth book cover 18. The sides 48 can be paperboard. On the outside of the paperboard sides 48 is a fabric cover 52 which may be of cloth. In FIGS. 6 and 7 it is seen that the fabric cover 52 extends around the outer edges of the stiff paperboard 48 and, partially overlies the exposed surface of the stiff paperboard 48 at 53 and has an edge 55. A center or spine section 41 of the backing sheet 40 is not adhered to a center section **52*a* of the fabric bookcover 52. The adhesive 44 is applied at the opposing ends opposite each pocket and continues inward up to but not including the center section 41. When bonded, the insert 16 becomes an integral part of the rigid cloth bookcover and is permanently secured to the cover except for the center section 41 which has free movement. The free movement of the center section 52*a* of the fabric cover 52 allows the combination of the rigid cloth bookcover 18, the insert 16, and the paperback book 24** to be opened and closed with ease.

The paperback book 24 has a flexible cover 54 which may be of paper. The outer parts of the paper cover 54 are inserted into the pockets 42. This partially assists in positioning of the paperback book spine 22 with respect to the insert 16. The result is that in a few minutes and with a few steps, a paperback book can be converted, permanently, into a hardcover book.

A manufacturer unites the insert 16 and the rigid cloth hard cover 18. For example, the manufacturer of the hardcover 18 can apply the insert 16 to the hardcover to form a combination interface-and-hardcover. The combination can be packaged. A person having a paperback book could purchase the combination in a package and combine the paperback book and the combination to have a book with a hardcover or the entire package including the paperback prebonded to the insert with hardcover could be sold to a purchaser.

More, explicitly, the book maker would manufacture the insert 16 and bond the insert to the hardcover 18 to make the combination interface-and-hardcover. The manufacturer would sell the combination in various sizes, to retail book outlets. The public would purchase a paperback and also purchase the combination, i.e., a hard cover for paperbacks, for permanent conversion of the paperback at the time of the purchaser's choosing. The concept is that the paperback consumer would have the choice and the ability to convert the desired paperback books to hardcover books. The insert 16 and the rigid bookcover 18 can be made in appropriate sizes to fit any size paperbook to the hardcover in a minute or two.

In FIG. 6 it is seen that edge 45 at the junction of backing sheet 40 and the outer sheet 43 is juxtapositioned to the edge 55 of the overlaying portion of the rigid cloth cover 18 at 53 when the insert 16 and the rigid cloth book cover 18 are united.

Also, in FIG. 6 there is illustrated the step of uniting the insert 16 and the paperback book 24. The paper backing 38 of the insert 16 is being peeled away from the adhesive 36 and the paperback book 24 is being pressed against the adhesive 36 and is being permanently bonded to the adhesive 36.

Although but one specific embodiment of this invention is herein shown and described it will be understood that details of the construction or materials used may be made by those skilled in the art without departing from the spirit and scope of the invention.

From the foregoing description of the invention, it is seen that the invention provides an inexpensive apparatus to combine a paperback book with a rigid cloth book cover so as to have a hard cover book. The apparatus makes it possible for many people to convert a paperback book to a hard cover book.

From the foregoing and having presented my invention, what I claim is:

1. The combination of a book having a plurality of pages and a cover for said book:

a. said book having a spine and a protective cover;

b. said cover for said book comprising:

c. a first flexible, limber sheet;

d. a first stiff side panel connecting with and on the inside surface of said first flexible, limber sheet;

e. a second stiff side panel connecting with and on the inside surface of said first flexible, limber sheet;

f. said first and said second stiff panels being spaced apart on said first flexible, limber sheet to allow movement between said first panel and said second panel and to allow said first and said second panels to overlie each other when the cover is folded closed;

g. a second flexible limber sheet connecting with and on the inside surface of said first and said second panels to allow said panels to move with respect to each other for folding the cover;

h. a first compressible resilient material connecting with said second flexible limber sheet and positioned between said first panel and said second panel, said first compressible resilient material, in cross-section, being of a generally elliptical configuration; and, i. a first means for adhesively connecting said book spline to said first compressible resilient material.

2. A combination according to claim 1 and further comprising:

j. said first compressible resilient material connecting with and on the inside surface of said second flexible limber sheet.

3. A combination according to claim 1 and further comprising:

j. said first compressible resilient material connecting with and on the inside surface of said second flexible limber sheet;

k. a second compressible resilient material connecting with and on the inside surface of said first compressible resilient material; and, l. a means for connecting together said second compressible resilient material and said book spine.

4. A combination according to claim 3 and further comprising:

m. said second flexible limber material having a first free outer edge and a second free outer edge;

n. said first free outer edge being folded over said second flexible limber sheet to form a pocket to receive part of said protective cover and, o. said second free outer edge being folded over said second flexible limber sheet to form a pocket to receive part of said protective cover.

5. A combination according to claim 4 and further comprising:

p. said protective cover being a flexible, limber, pliable material.

6. A method for making a hard cover for a book having a plurality of separate pages and a back, said method comprising:

a. selecting a first flexible limber sheet;

b. attaching a first stiff material to a first side of said first flexible limber sheet;

c. attaching a second stiff material to said first side of said first flexible limber sheet in a spaced apart relation to said first stiff material to allow movement of said first flexible limber sheet and to allow said first stiff material to overlie each other;

d. attaching a second flexible limber sheet to said first stiff material and to said second stiff material to allow said first stiff material and said second stiff material to overlie each other; and, e. positioning a first compressible reilient material between said first stiff material and said second stiff material for being close to said back of said book, said first compressible resilient material, in cross-section, being of a generally, elliptical configuration.

7. A method according to claim 6 and further comprising:

f. connecting said first compressible resilient material with said second flexible limber sheet.

8. A method according to claim 6 and further comprising:

f. providing said second flexible limber material with a first free outer edge and a second free outer edge;

g. overlaying said first free outer edge over said second flexible limber sheet to form a pocket to receive a first part of said book; and, h. overlaying said second free outer edge over said second flexible limber sheet to form a pocket to receive a second part of said book.

9. A method for making a hard cover for a book having a back and a protective cover, said method comprising:

a. selecting a first flexible limber sheet;

b. attaching a first stiff material to a first side of said first flexible limber sheet;

c. attaching a second stiff material to said first side of said flexible limber sheet in a spaced apart relation to said first stiff material to allow movement of said first flexible limber sheet and to allow said first stiff material to overlie each other;

d. attaching a second flexible limber sheet to said first stiff material and to said second stiff material to allow said first stiff material and said second stiff material to overlie each other;

e. positioning a first compressible resilient material between said first stiff material and said second stiff material for being close to said back of said book, said first compressible resilient material, in cross-section, being of a generally, elliptical configuration; and, f. operatively connecting together said protective cover of said book to said second flexible limber sheet.

10. A method according to claim 9 and further comprising:

g. connecting said first compressible resilient material with said second flexible limber sheet.

11. A method according to claim 9 and further comprising:

g. providing said second flexible limber material with a first free outer edge and a second free outer edge;

h. overlaying said first free outer edge over said second flexible limber sheet to form a first pocket.

i. placing a first part of said protective cover in said first pocket.

j. overlaying said second free outer edge over said second flexible limber sheet to form a second pocket; and, k. placing a second part of said protective cover in said second pocket.

12. A method according to claim 11 and further comprising:

l. connecting said first compressible resilient material with said second flexible limber sheet; and, m. operatively connecting said first compressible resilient material and the back of said book to form an integral unit out of said book and said hard cover.

13. A method for converting a paperback book to a hardback book, said method comprising:

a. supplying a narrow, stiff piece of material with a configuration typical of that of the spine of a book, said stiff material having a first side, which is convex, and a second side, which is concave;

b. supplying a compressible solid foam having a first side and a second side, said compressible solid foam in cross section having a generally elliptical configuration;

c. connecting together said first side of said compressible solid foam and said second side of said stiff material using an adhesive;

d. supplying a backing material;

e. supplying a hard book cover having two spaced-apart stiff panel portions and a flexible hinge portion connected therebetween;

f. connecting together a central portion of said backing material and said first side of said stiff material using an adhesive;

g. connecting together portions of said backing material located to each side of said central portion and said two spaced-apart stiff panel portions using an adhesive;

h. supplying a paperback book having a spine; and i. connecting together said book spine and said second side of said compressible solid foam using an adhesive.

14. A method according to claim 13 further including supplying a first longitudinal end guide juxtapositioned to one end of said compressible solid foam and a second longitudinal end guide juxtapositioned to the other end of said compressible solid form to assist in longitudinal positioning of said book spine with respect to said compressible solid foam.

15. A method for converting a paperback book to a hardback book, said method comprising:

a. supplying a narrow, stiff piece of material, said stiff material having a first side and a second side;

b. supplying a compressible and resilient material, operatively deformable in response to opening and closing of the paperback book during usage, and having a first side and a second side, said second side having a generally convex shape;

c. connecting together said first side of said compressible material and said second side of said stiff material using an ahesive;

d. supplying a backing material;

e. supplying a hard book cover having two spaced-apart stiff panel portions and a flexible hinge portion connected therebetween;

f. connecting together a central portion of said backing material and said first side of said stiff material using an adhesive;

g. connecting together portions of said backing material located to each side of said central portion and said two spaced-apart stiff pannel portions using an adhesive;

h. supplying a paperback book having a spine; and i. connecting together said book spine and said second side of said compressible material using an adhesive.

16. A method according to claim 15 further including supplying a first longitudinal end guide at one end of said compressible material and a second longitudinal end guide at the other end of said compressible material to assist in aligning said spine of said paperback book with respect to said hard book cover.

17. A cover for a book having a plurality of pages, said cover comprising:

a first flexible sheet;

a first stiff material and a second stiff material attached to said first flexible sheet, said first and second stiff materials being spaced apart on said first flexible sheet to allow movement between said first and second stiff materials, and allow said first stiff material and said second stiff material to overlie each other; and a second flexible sheet attached to said first and second stiff materials inward of said first flexible sheet;

a narrow, stiff piece of material with a configuration typical of that of the spine of a book, said stiff spine material having a first side, which is convex, and a second side, which is concave, said first side being attached to the inside of said second flexible sheet;

a compressible resilient material positioned between said first stiff material and said second stiff material, said compressible resilient material having a first convex side attached to said second side of said stiff spine material and a second convex side attachable to the spine of the book to position the book between said first and second stiff materials.

18. A cover for a book having a plurality of pages, said cover comprising:

a flexible sheet having a central portion and first and second end portions, one to each side of said central portion;

a first stiff material attached to said first end portion of said flexible sheet and a second stiff material attached to said second end portion of said flexible sheet, said first and second stiff materials being spaced apart on said flexible sheet to allow movement between said first and second stiff materials, and allow said first stiff material and said second stiff material to overlie each other; and a compressible resilient material positioned between said first stiff material and said second stiff material and held therebetween in alignment with said central portion of said flexible sheet, said compressible resilient material having a first convex side facing inwardly toward said flexible sheet and a convex second side facing outwardly away from said flexible sheet, said second side being attachable to the spine of the book to position the book between said first and second stiff materials.

19. The cover of claim 18 wherein said first and second stiff materials are attached to the inside of said flexible sheet, and further including a second flexible sheet attached to said first and second stiff materials inward of said first flexible sheet, and wherein said first side of said compressible resilient material is attached to the inside of said second flexible sheet.

20. The cover of claim 19 including a narrow, stiff piece of material with a configuration typical of that of the spine of a book, said stiff material having a first side, which is convex, and a second side, which is concave, said first side being attached to the inside of said second flexible sheet, and said second side being attached to said first side of said compressible resilient material.

21. The cover of claim 19 wherein said second flexible sheet further includes first and second opposing pockets positioned at opposite ends of said second flexible sheet, whereby said pockets can receive part of the soft cover when the cover is used for a paperback book.

22. The cover of claim 18 wherein said compressible resilient material has a first portion having a generally elliptical configuration and a second portion having a substantially uniform thickness, and an adhesive surface forming said second side of said compressible resilient material, said first and second portions being affixed together.

23. The cover of claim 18 wherein said second side of said compressible resilient material has an adhesive surface with a peel-away cover, whereby said cover can be peeled away to expose said adhesive surface in preparation for attachment of the spine of the book to said second side of said compressible resilient material.

24. The cover of claim 18 further including a first longitudinal end guide positioned toward one end of said compressible resilient material and a second longitudinal end guide positioned toward the other end of said compressible resilient material, said first and second end guides permitting alignment of the spine of the book relative to said compressible resilient material in preparation for attachment of the spine thereto.

25. A cover for a book having a plurality of pages, said cover comprising:

a hard book cover having two spaced-apart stiff panel portions and a flexible hinge portion to allow movement between said panel portions, and allow said panel portions to overlie each other; and a compressible resilient material positioned between said panel portions, said compressible resilient material having a first side bonded to said hard book cover and a second side bondable to the spine of the book to position the book between said panel portions, said compressible resilient material having a sufficient thickness and compressibility to compress upon closing of the book while conforming to the shape of the book spine, and to expand upon opening of the book while maintaining continuous contact with the hard book cover and the book spine in response to the changing curvature of the book spine as the book opens and closes, without applying a significant detachment force on the bond between said first side of said compressible resilient material and said hard book cover or the bond between said second side of said compressible resilient material and the book spine under repeated opening and closing of the book, whereby said compressible resilient material conforms to the shape of the book spine and maintains contact therewith as the book spine moves between a concave and a flat or slightly convex shape as the book is opened and closed, respectively, without pulling said compressible resilient material free from said hard book cover or the book spine.

26. The cover of claim 25 further including a flexible sheet attached to said panel portions, and wherein said first side of said compressible resilient material is attached to the inside of said flexible sheet.

27. The cover of claim 26 including a narrow, stiff piece of material with a first side, and a second side, said first side being attached to the inside of said flexible sheet, and said second side being attached to said first side of said compressible resilient material.

28. The cover of claim 27 wherein said narrow, stiff material has a configuration typical of that of the spine of a book with said first side being convex and said second side being concave, and wherein said first and second sides of said compressible resilient material are convex.

29. The cover of claim 25 wherein said second side of said compressible resilient material has an adhesive surface with a peel-away cover, whereby said cover can be peeled away to expose said adhesive surface in preparation for attachment of the spine of the book to said second side of said compressible resilient material.

30. A cover for a book having a plurality of pages, said cover comprising:

a hard book cover having two spaced-apart stiff panel portions and a flexible hinge portion to allow movement between said panel portions, and allow said panel portions to overlie each other;

a compressible resilient material positioned between said panel portions, said compressible resilient material having a first side attached to said hard book cover and a second side with a convex shape attachable to the spine of the book to position the book between said panel portions; and a first longitudinal end guide positioned toward one end of said compressible resilient material and a second longitudinal end guide positioned toward the other end of said compressible resilient material, said first and second end guides permitting alignment of the spine of the book relative to said compressible resilient material in preparation for attachment of the spine thereto.

31. A method for making a hard cover for a book having a plurality of pages, said method comprising:

a. supplying a hard book cover having two spaced-apart stiff panel portions and a flexible hinge portion therebetween to allow movement between said panel portions, and allow said panel portions to overlie each other;

b. supplying a compressible resilient material with a first side bondable to said hard book cover and a second side bondable to the spine of the book, and providing said compressible resilient material with a sufficient thickness and compressibility to compress upon closing of the book while conforming to the shape of the book spine, and to expand upon opening of the book while maintaining continuous contact with the hard book cover and the book spine in response to the changing curvature of the book spine as the book opens and closes, without applying a significant detachment force on the bond between said first side of said compressible resilient material and said hard book cover or the bond between said second side of said compressible resilient material and book spine under repeated opening and closing of the book;

c. positioning said compressible resilient material between said panel portions; and d. attaching said first side of said compressible resilient material to said hard book cover.

32. A method according to claim 31 further including supplying a flexible sheet; attaching said flexible sheet to said panel portions; and attaching said first side of said compressible resilient material to the inside of the said flexible sheet.

33. The method of claim 32 further including supplying a narrow stiff piece of material with a first side and a second side, and attaching said first side to the inside of said flexible sheet and said second side to said first side of said compressible material.

34. The method according to claim 33 wherein said stuff piece of material has a configuration typical of that of the spine of a book with said first side being convex and said second side being concave.

35. A method for making a hard cover for a book having a plurality of pages, said method comprising:

a. supplying a hard book cover having two spaced-apart stiff panel portions and a flexible hinge portion therebetween to allow movement between said panel portions, and allow said panel portions to overlie each other;

b. supplying a compressible resilient material with a first side attachable to said hard book cover and a second side with a convex shape attachable to the spine of the book, and providing said compressible resilient material with, in cross section, a generally elliptical configuration;

c. positioning said compressible resilient material between said panel portions; and d. attaching said first side of said compressible resilient material to said hard book cover.

36. A method for making a hard cover for a book having a plurality of pages, said method comprising:

a. supplying a hard book cover having two spaced-apart stiff panel portions and a flexible hinge portion therebetween to allow movement between said panel portions, and allow said panel portions to overlie each other;

b. supplying a compressible resilient material with a first side attachable to said hard book cover and a second side with a convex shape attachable to the spine of the book;

c. positioning said compressible resilient material between said panel portions;

d. attaching said first side of said compressible resilient material to said hard book cover; and e. supplying first and second longitudinal end guides, and positioning said first end guide toward one end of said compressible resilient material and said second end guide toward the other end of said compressible material, whereby said first and second end guides permit alignment of the spine of the book relative to the compressible resilient material in preparation for attachment of the spine thereto.

37. An insert attachable to a hard book cover having two spaced-apart panel portions and a flexible hinge portion therebetween, comprising:

a flexible sheet attachable to the panel portions to allow the panel portions to fold to overlie each other;

a narrow, stiff piece of material with a configuration typical of that of the spine of a book, said stiff material having a first side, which is convex, and a second side, which is concave, said first side being attached to the inside of said flexible sheet; and a compressible resilient material, in cross-section, being of a generally elliptical configuration, with a first side connected to said second side of said narrow, stiff piece of material, and a second side attachable to the spine of a book to position the book between the panel portions.

38. The insert of claim 37 wherein said flexible sheet further includes first and second opposing pockets positioned at opposite ends of said flexible sheet.

39. The insert of claim 38 wherein said flexible resilient material has an adhesive surface with a peel-away cover.

40. The insert of claim 39 further including a first longitudinal end guide position toward one end of said compressible resilient material and a second longitudinal end guide positioned toward the other end of said compressible material, said first and second end guides permitting alignment of the spine of the book relative to said compressible resilient material in preparation for attachment of the spine thereto.

* * * * *

UNITED STATES PATENT AND TRADEMARK OFFICE

CERTIFICATE OF CORRECTION

PATENT NO. : 4,650,216
DATED : March 17, 1987
INVENTOR(S) : Dennis W. Carlson

It is certified that error appears in the above—identified patent and that said Letters Patent is hereby corrected as shown below:

In the Claims:

Claim 1, line 63, the word "spline" should be changed to --spine--.

Claim 6, line 40, the word "reilient" should be changed to --resilient--.

Claim 9, line 67, the word --first-- should be inserted after the word "said".

Claim 14, line 5, the word "form" should be changed to --foam--.

Claim 31, line 21, the word --the-- should be inserted after the word "and".

Claim 34, line 40, the word "stuff" should be changed to --stiff--.

Signed and Sealed this

Twenty-second Day of December, 1987

*Attest:*

DONALD J. QUIGG

*Attesting Officer*

*Commissioner of Patents and Trademarks*